United States Patent [19]

Sugiyama et al.

[11] 3,989,528

[45] Nov. 2, 1976

[54] DYE-CONTAINING SILVER HALIDE PHOTOGRAPHIC LIGHT-SENSITIVE MATERIAL

[75] Inventors: Masatoshi Sugiyama; Tohru Sueyoshi; Yasuharu Nakamura; Takeo Shimada; Koutaro Yamasue, all of Minami-ashigara, Japan

[73] Assignee: Fuji Photo Film Co., Ltd., Minami-ashigara, Japan

[22] Filed: May 19, 1975

[21] Appl. No.: 578,798

[30] Foreign Application Priority Data

May 17, 1974 Japan ..... 49-55110

[52] U.S. Cl. ..... 96/84 R; 96/140; 96/74; 96/69

[51] Int. Cl.[2] ..... G03C 1/84

[58] Field of Search ..... 96/84 R, 140, 69, 74

[56] References Cited

FOREIGN PATENTS OR APPLICATIONS 1,338,799 7/1971 United Kingdom
1,373,026 6/1974 United Kingdom

OTHER PUBLICATIONS

Chem. Abstracts, vol. 77, Col. 27415r, (1972).

*Primary Examiner*—John D. Welsh
*Attorney, Agent, or Firm*—Sughrue, Rothwell, Mion, Zinn & Macpeak

[57] ABSTRACT

A silver halide photographic light-sensitive material having at least one hydrophilic layer to be dyed and containing, in a hydrophilic layer to be dyed, a dye represented by the following general formula (I):

(I)

wherein R represents an alkyl group or an alkenyl group; A represents an imino group (—NH—); Y represents an oxygen atom or a sulfur atom; Q represents an aryl group substituted with at least one of a sulfo group, a sulfoalkyl group and a carboxy group; L represents a methine group; n represents an integer of 0 to 1, and m and p each represents an integer of 0, 1 or 2; a silver halide photographic light-sensitive material containing at least one spectrally sensitized silver halide emulsion layer and in at least one hydrophilic layer to be dyed of the photographic light-sensitive material, at least one dye represented by general formula (I) as set forth above; and a silver halide photographic light-sensitive material containing at least three silver halide emulsion layers having different spectral sensitivities, with at least two of the silver halide emulsion layers being spectrally sensitized and in at least one hydrophilic layer to be dyed of the photographic light-sensitive material, at least one dye represented by general formula (I) as set forth above.

9 Claims, 4 Drawing Figures

DYE-CONTAINING SILVER HALIDE PHOTOGRAPHIC LIGHT-SENSITIVE MATERIAL

BACKGROUND OF THE INVENTION

1. Field of the Invention

The present invention relates to a silver halide photographic light-sensitive material having a dyed hydrophilic colloidal layer or layers. In particular, it is concerned with a silver halide photographic light-sensitive material containing a hydrophilic colloidal layer or layers dyed with a dye which does not detrimentally influence the spectral sensitivity of the photographic emulsion layers.

2. Description of the Prior Art

With silver halide photographic light-sensitive materials, photographic emulsion layers and like layers are often dyed for the purpose of absorbing light in a specific wavelength region.

Where it is necessary to control the spectral composition of light incident upon photographic emulsion layers, a colored layer is usually provided on a side farther from the support than the photographic emulsion layers in a photographic light-sensitive material. Such a colored layer is called a filter layer. Where a plurality of photographic emulsion layers are present as in a multi-layer color light-sensitive material, such a filter layer is sometimes interposed between photographic emulsion layers.

Where the intention is to prevent images from becoming indistinct, i.e., halation, due to light scattered during or after transmission through the photographic emulsion layers and reflected at the interface between an emulsion layer and a support or at the opposite surface of the light-sensitive material to the emulsion layers and again striking the photographic emulsion layers, a colored layer is provided between a photographic emulsion layer and a support or on an opposite side of the support to the photographic emulsion layers. Such colored layers are called antihalation layers. Where a plurality of photographic emulsion layers are present as in a multi-layer color light-sensitive material, the antihalation layer is in some cases interposed between these photographic emulsion layers.

In order to prevent a reduction in image sharpness due to the scattering of light in photographic emulsion layers (this phenomenon being usually called irradiation), the photographic emulsion layers are also colored.

These layers to be colored, in many cases, comprise a hydrophilic colloid, and hence water-soluble dyes are usually incorporated in these layers to color the layers. Dyes to be used for this purpose must satisfy the following criteria as well as possess an appropriate spectral absorption in accordance with the end-use of the photographic light-sensitive material:

1. The dyes should be chemically photographically inert, that is, they should not chemically detrimentally influence the properties of silver halide photographic emulsion layers, such as cause a reduction in sensitivity, cause the latent image to fade or cause fog.

2. The dyes should be capable of being decolored or dissolved out into a processing solution or into a wash water during the photographic processing steps, and harmful residual color of the dye should not remain in the processed photographic light-sensitive material.

Of the above-described two criteria, the first criterion of being chemically photographically inert should be satisfied with respect to properties in spectrally sensitized regions as well as in the intrinsic sensitivity region of silver halide, i.e., the wavelength region of intrinsic absorption of silver halide. That is, i. the dyes should not spectrally sensitize photographic emulsions which have not been spectrally sensitized (spectral sensitization would make the use of a safe light difficult in handling light-sensitive materials in a dark room), ii. the dyes should not reduce the spectral sensitization efficiency of a spectrally sensitized photographic emulsion, iii. the dyes should not shift the wavelength of spectral sensitization maximum or not produce a new spectral sensitization maximum, and iv. the dyes should not affect the spectral sensitization characteristics, for example, widen or narrow the spectrally sensitized region.

As the water-soluble dyes useful for dyeing hydrophilic colloidal layers of a photographic light-sensitive material for the above-described objects, many dyes are known. For example, oxonol dyes having pyrazolone nuclei, represented by the dyes described in British Pat. No. 506,385; oxonol dyes having barbituric acid nuclei, represented by the dyes described in U.S. Pat. No. 3,247,127; other oxonol dyes described in U.S. Pat. Nos. 2,533,472, 3,379,533, British Pat. No. 1,278,621; hemioxonol dyes represented by the dyes described in British Pat. No. 584,609; styryl dyes represented by the dyes described in U.S. Pat. No. 2,298,733; merocyanine dyes represented by the dyes described in British Pat. No. 1,153,341; cyanine dyes represented by the dyes described in U.S. Pat. No. 2,843,486; and the like, are illustrative.

Of these, symmetrical oxonol dyes having two pyrazolone nuclei have been used as useful dyes for dyeing layers of a light-sensitive material since they can be decolored in a developer containing sulfite, they affect the photographic properties of photographic emulsions only to a slight extent, and they can be synthesized in a good yield with high purity.

However, many of the dyes belonging to this class spectrally sensitize photographic emulsions (which have not been spectrally sensitized). For example, a dye having the following structural formula:

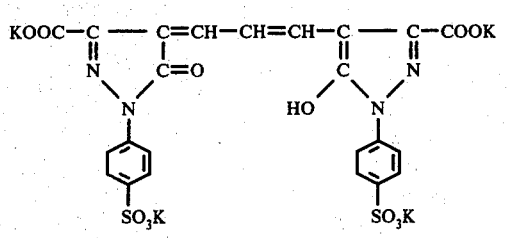

(A)

can spectrally sensitize a pure silver bromide emulsion or a silver bromoiodide emulsion have a low iodide content to produce a spectrally sensitized region at around 590 nm which is quite different from their spectral absorption region. Also, many of them detrimentally influence the spectral sensitivity characteristic of a silver halide emulsion sensitized with a sensitizing dye, regardless of the effect on their spectral absorption. That is, they not only reduce the sensitization in the wavelength region of main spectral sensitization, but produce a new spectral sensitivity as well in a wavelength region where spectral sensitivity is not desired. For example, when the aforesaid dye (structural formula A) is added to a silver bromoiodide emulsion layer (containing 1 mol% iodide) spectrally sensitized with 2-[(3-ethyl-4,5-diphenyl-thiazolyl)methylidene]-5-[2-(3-ethylbenzothiazolylidene)ethylidene]-3-methyl-thiazolidin-4-one or to an adjacent gelation layer, spectral sensitization at the main sensitization wavelength (640 nm) is reduced and, in addition, a new spectral sensitization appears in the wavelength region of 500 to 520 nm. Production of spectral sensitivity due to the presence of such a dye in a photographic emulsion which has not been spectrally sensitized or production of a new spectral sensitization in a spectrally sensitized photographic emulsion results in a photographic light-sensitive material having various disadvantages. Firstly, it greatly degrades the adaptability of a photographic light-sensitive material to a safe light. That is, the wavelength region capable of being used for safe light illumination is extremely limited or the conditions permitting the handling of a photographic light-sensitive material under a safe light (e.g., the closest distance from the light source, the longest handling time, etc.) are extremely restricted. Also, with a multi-layer color light-sensitive material, the spectral sensitivity of one emulsion layer overlaps that of other layers to a greater extent. Thus, color separation between each layer and, therefore, color reproduction of the color image are deteriorated.

SUMMARY OF THE INVENTION

An object of the present invention is to provide a silver halide photographic light-sensitive material having a dyed hydrophilic colloidal layer in which light fog due to safe light illumination barely occurs.

Another object of the present invention is to obtain a silver halide photographic light-sensitive material containing a hydrophilic colloidal layer dyed with a water-soluble dye which does not detrimentally influence the spectral sensitization characteristics of a spectrally sensitized silver halide photographic emulsion layer.

A further object of the present invention is to obtain a color photographic light-sensitive material bearing a dye-contaning hydrophilic colloidal layer and having good color separation property between each photographic emulsion layer corresponding to each color image of the three primary colors.

These and other objects of the present invention are attained in one embodiment of this invention by incorporating, in a hydrophilic colloidal layer to be dyed of a silver halide photographic light-sensitive material having at least one hydrophilic layer to be dyed, a dye represented by the following general formula (I):

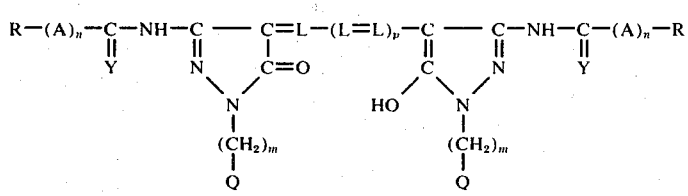

(I)

wherein R represents an alkyl group, a substituted alkyl group or an alkenyl group; A represents an imino group (—NH—); Y represents an oxygen atom or a sulfur atom; Q represents an aryl group substituted with at least one of a sulfo group, a sulfoalkyl group and a carboxy group; L represents a methine group which may be substituted; $n$ is 0 or 1; and $m$ and $p$ each represents an integer of 0, 1 or 2.

These and other objects of the present invention are attained in a second embodiment of this invention by incorporating in at least one hydrophilic colloidal layer of a silver halide photographic light-sensitive material containing at least one spectrally sensitized silver halide emulsion layer, the dye of the above-described general formula (I).

These and other objects of the present invention are attained in a third embodiment of this invention by incorporating a dye represented by the foregoing general formula (I) in at least one hydrophilic layer of a silver halide color light-sensitive material containing at least three silver halide emulsion layers having different spectral sensitivities, with at least two of the silver halide emulsion layers being spectrally sensitized.

DETAILED DESCRIPTION OF THE INVENTION

Figure 1:
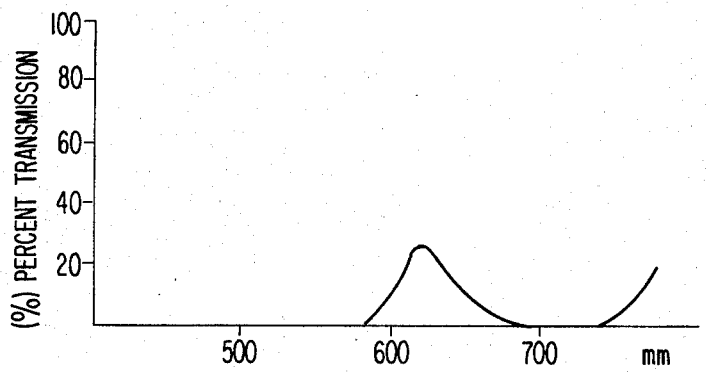
FIG. 1 shows the spectral transmission curve of a Fuji Safe Light Filter used in Example 1.

In the above general formula (I), R represents an alkyl group having 1 to 10 carbon atoms (e.g., a methyl group, an ethyl group, a butyl group, an octyl group, etc.), a substituted alkyl group (e.g., an alkyl group containing a halogen atom (e.g., a chlorine atom, a bromine atom, etc.), an alkoxycarbonyl group (e.g., having 1 to 3 carbon atoms in the alkoxy moiety thereof such as a methoxycarbonyl group or an ethoxycarbonyl group, etc.), a cyano group, or the like, etc., as a substituent and having 1 to 6 carbon atoms in the alkyl moiety thereof) or an alkenyl group having 2 to 4 carbon atoms (e.g., a vinyl group, an allyl group, etc.); A represents an imino group (—NH—); Y represents an oxygen atom or a sulfur atom; Q represents an aryl group (e.g., a phenyl group, a naphthyl group, etc.) substituted with at least one sulfo group, sulfoalkyl group or carboxy group (e.g., a 4-sulfophenyl group, a 4-(sulfomethyl)phenyl group, a 4-(δ-sulfobutyl)phenyl group, a 2,5-disulfophenyl group, a 6,8-disulfo-2-naphthyl group, a 4-carboxyphenyl group, 3,5-dicarboxyphenyl group, etc.), and the aryl group can contain a substituent other than a sulfo group, a sulfoalkyl group and a carboxy group (e.g., an alkyl group having 1 to 5 carbon atoms (e.g., a methyl group, an ethyl group, etc.), a halogen atom (e.g., a chlorine atom, a bromine atom, etc.), an alkoxy group having 1 to 4 carbon atoms (e.g., a methoxy group, an ethoxy group, etc.) or a phenoxy group), and the sulfo group, the sulfoalkyl group or the carboxy group may be in the form of a salt with an alkali metal (e.g., sodium, potassium, etc.), an alkaline earth metal (e.g., magnesium, calcium, etc.), ammonia, an organic amine (e.g., diethylamine, triethylamine, morpholine, pyridine, piperidine, etc.) or the like. The aryl group of Q can contain from 1 to 3 sulfo groups, sulfoalkyl groups and/or carboxy groups and from 0 to 2 substituents other than sulfo groups, sulfoalkyl groups and carboxy groups. $n$ is 0 or 1, $m$ represents an integer of 0, 1 or 2, L represents a methine group, and $p$ represents an integer of 0, 1 or 2. The methine group forming the methine chain represented by $=L-(L=L)_p-$ can be substituted with an alkyl group having 1 to 3 carbon atoms (e.g., a methyl group, an ethyl group, an isopropyl group, etc.), a phenyl group, a benzyl group, a phenethyl group or a halogen atom (e.g., a chlorine atom, a bromine atom, etc.).

A preferred substituent represented by R in the general formula (I) is an alkyl group, with a methyl or ethyl group being particularly preferred. The imino group A is preferably present, i.e., $n$ is preferably 1, and the divalent atom Y is preferably an oxygen atom. Preferred substituents represented by Q are a phenyl or naphthyl group substituted with 1 or 2 sulfo groups, with a 4-sulfophenyl group being particularly preferred. The sulfo groups are preferably in the form of a salt as the alkali metal, ammonium or organic amine salts. $m$ is preferably 0 or 1, with 0 being particularly preferred. The methine groups, L, are preferably unsubstituted or at least one of them is substituted, an unsubstituted methine group being particularly preferred.

Dyes represented by the general formula (I) belong to a class of symmetrical oxonol dyes from a chemical structural viewpoint, and are characterized by the substituents, $$R-(A)_n-\underset{\underset{Y}{\|}}{C}-NH-,$$

at the 3-positions of the two pyrazolone muclei

Specific examples of dyes which can be used in the present invention are illustrated below.

Dye 1

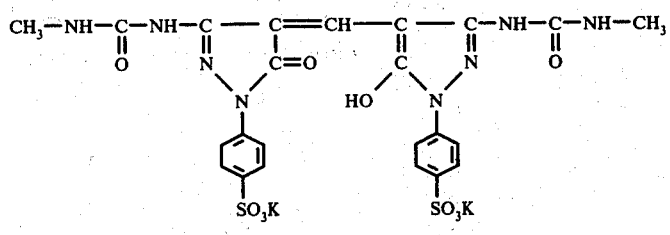

Dye 2

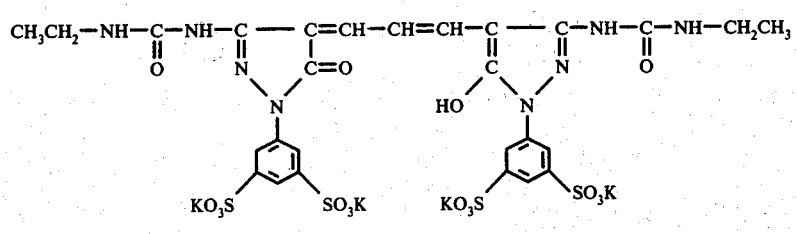

Dye 3

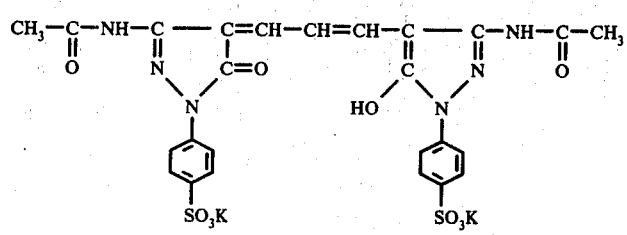

Dye 4
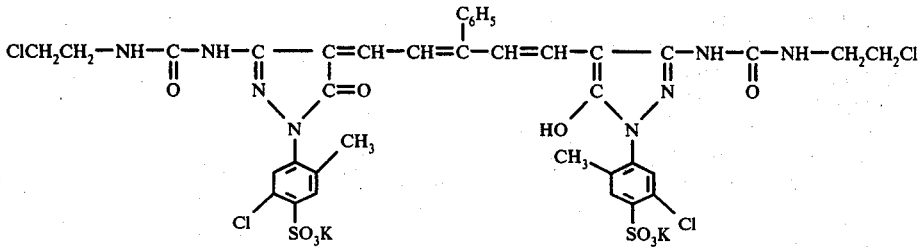
Dye 5
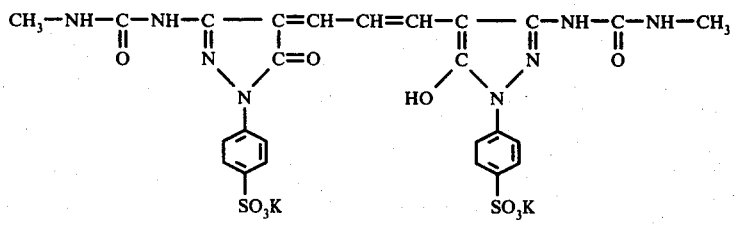
Dye 6
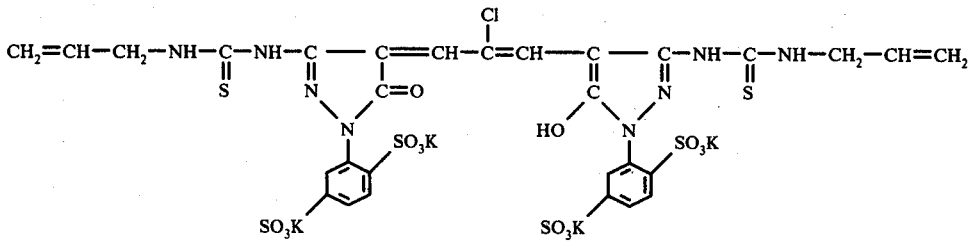
Dye 7
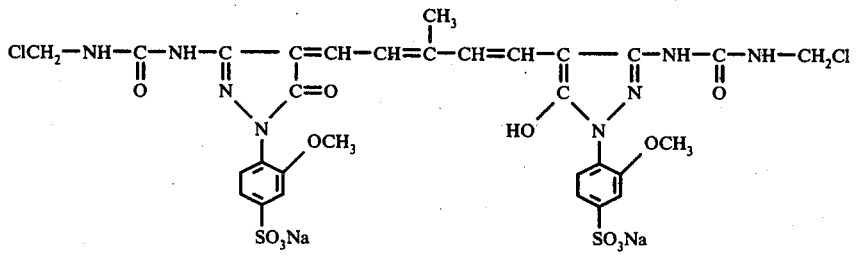
Dye 8
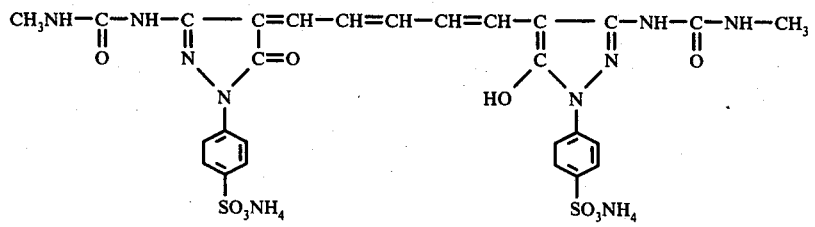

Dye 9
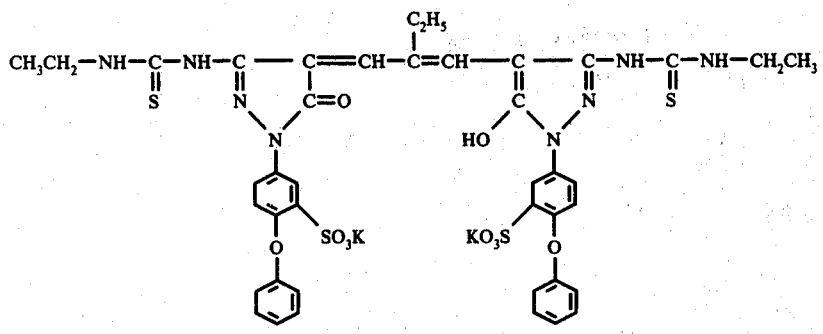
Dye 10
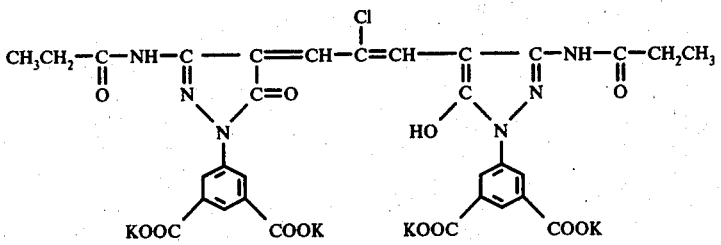
Dye 11
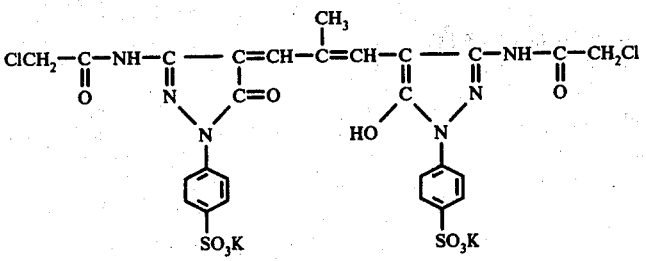
Dye 12
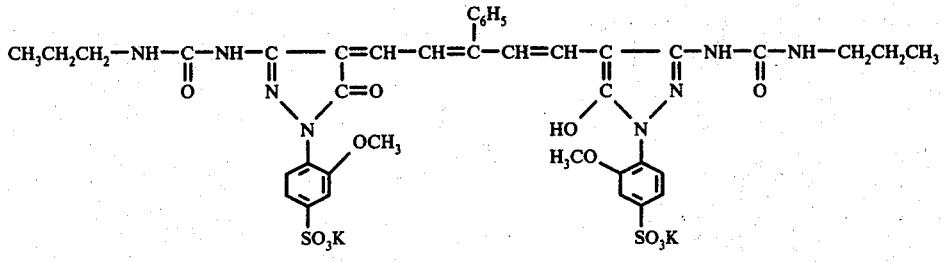
Dye 13
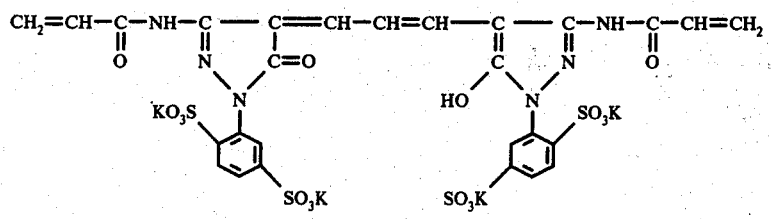

Dye 14
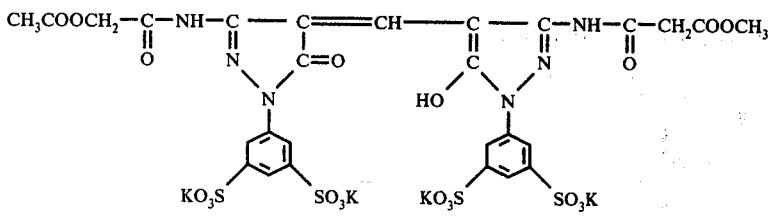
Dye 15
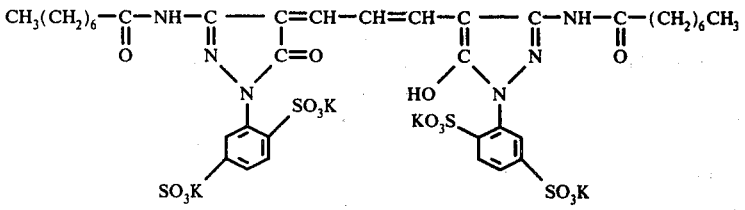
Dye 16
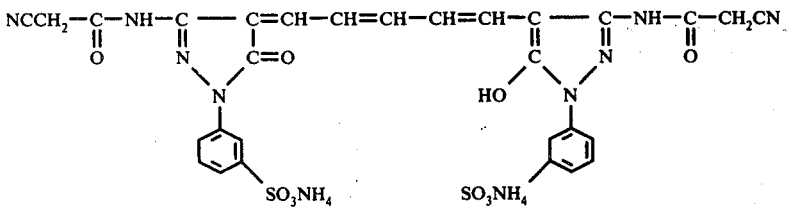
Dye 17
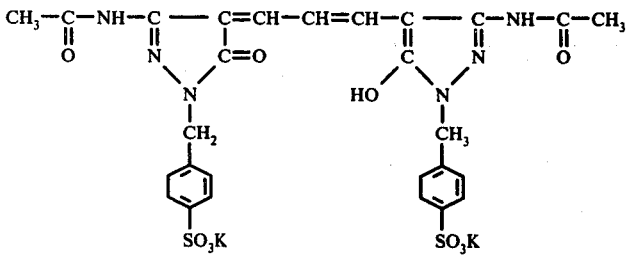
Dye 18
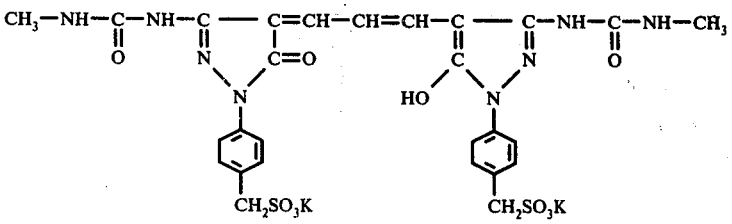

Dye 19
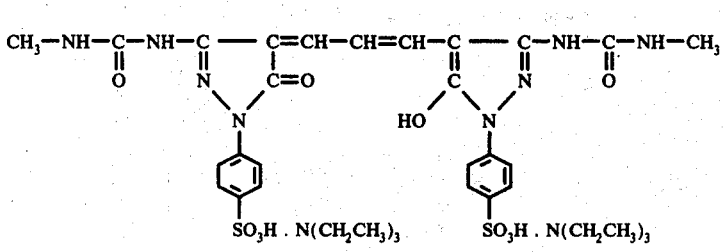
Dye 20
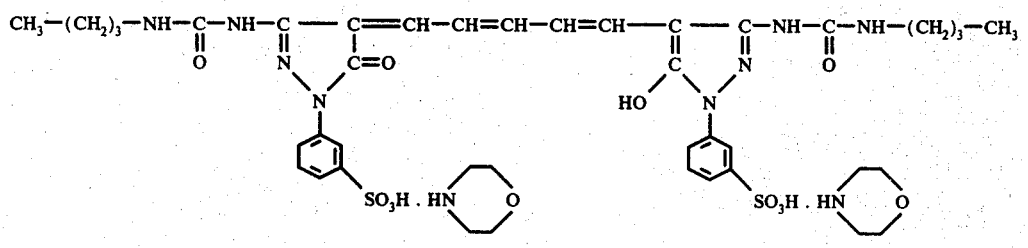
Dye 21
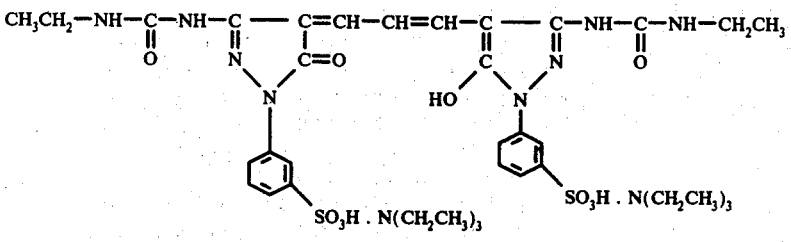
Dye 22
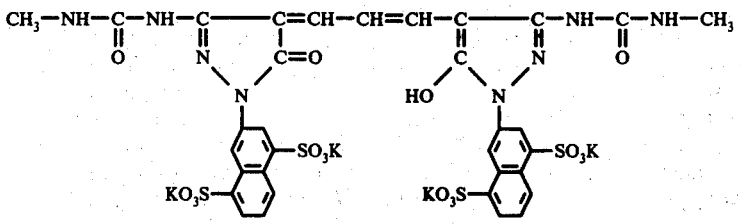
Dye 23
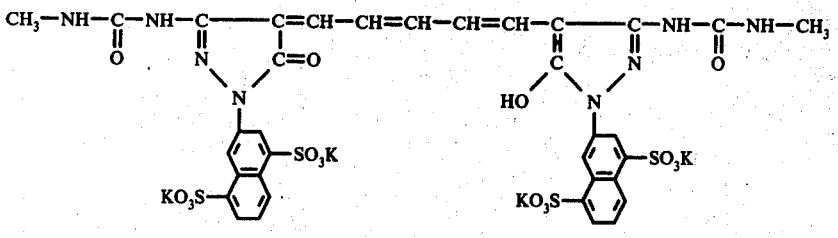

Dye 24

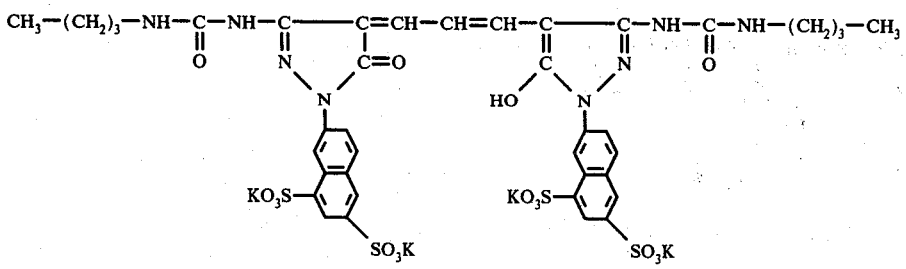

Dye 25

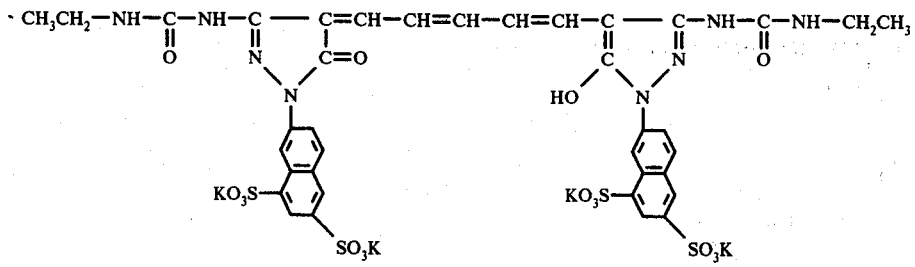

Oxonol dyes represented by the general formula (I) can be synthesized, e.g., according to the disclosure appearing in British Pat. No. 1,007,847 and U.S. Pat. No. 3,746,539, e.g., by condensing a pyrazolone derivative represented by the following formula (II) and a compound represented by the following formulas (III*a*), (III*b*), (III*c*), (III*d*) or (III*e*) in the presence of a base such as diethylamine, triethylamine, morpholine, pyridine or piperidine.

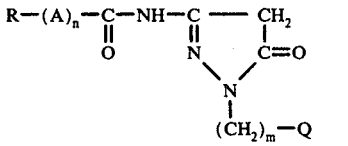

(II)

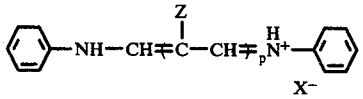

(IIIa)

$HC(OCH_2CH_3)_3$ (IIIb)

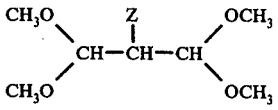

(IIIc)

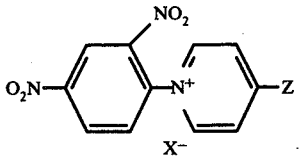

(IIId)

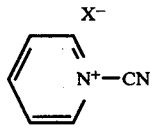

(IIIe)

In the above formulas, Q, R, A, *n*, *m* and *p* are the same as defined above, Z represents a hydrogen atom, a halogen atom (e.g., a chlorine atom), an alkyl group (e.g., a methyl group, an ethyl group, etc.), a phenyl group, a benzyl group or a phenethyl group, and X represents an anion (e.g., chloride, bromide, iodide, perchlorate, methylsulfate, ethylsulfate, p-toluenesulfonate, etc.).

As is clear from the foregoing specific examples, the sulfo group or the carboxy group of the dye can form a salt such as an alkali metal salt (e.g., a sodium salt, a potassium salt, etc.), an alkaline earth metal salt (e.g., a magnesium salt, a calcium salt, etc.), an ammonium salt, an organic amine salt (e.g., a triethylamine salt, a morpholine salt, a piperidine salt, etc.), or the like.

The synthesis of the dyes of the general formula (I) is described in detail in Japanese Patent Application (OPI) No. 91627/75 and is specifically explained by the following synthesis examples. Unless otherwise indicated herein, all parts, percents, ratios and the like are by weight.

SYNTHESIS EXAMPLE 1 (SYNTHESIS OF DYE 1)

A mixture comprising 6 g of 3-methylcarbamoyl-1-(4′-sulfophenyl)-5-pyrazolone, 2.3 g of diphenylformamidine, 2.2 g of triethylamine and 50 ml of methanol was refluxed for 3 hours on a steam bath. Then, 2 g of anhydrous potassium acetate dissolved in 20 ml of methanol was added thereto. Upon refluxing for 5 minutes, a yellow precipitate was formed. This precipitate was collected by filtration, washed well successively, with methanol and acetone, and dried to obtain 4.3 g of the dye. The absorption maximum wavelength of an aqueous solution of this dye was 400 nm.

SYNTHESIS EXAMPLE 2 (SYNTHESIS OF DYE 2)

A mixture comprising 8 g of 3-ethylureido-1-(3′,5′-disulfophenyl)-5-pyrazolone, 2.5 g of malondialdehyde di-anil hydrochloride, 5 g of triethylamine and 100 ml of methanol was refluxed for 5 hours on a steam bath. Then, 40 ml of a methanol solution containing 4 g of anhydrous potassium acetate was added thereto. Upon refluxing for 5 minutes, a red precipitate was formed. This precipitate was collected by filtration, washed successively with methanol and acetone, and dried to obtain 7.6 g of the dye. The absorption maximum wavelength of an aqueous solution of this dye was 509 nm.

SYNTHESIS EXAMPLE 3 (SYNTHESIS OF DYE 8)

A mixture comprising 6.2 g of 3-methylureido-1-(4'-sulfophenyl)-5-pyrazolone, 2.8 g of N-(2,4-dinitrophenyl)-pyridinium hydrochloride and 50 ml of ethanol was saturated with ammonia gas at 10° – 20° C with stirring to obtain a uniform solution. By stirring this solution for 24 hours, blue crystals were precipitated. The resulting crystals were collected by filtration, washed well with ethanol and acetone, and dried to obtain 5.3 g of Dye 8. The absorption maximum wavelength of an aqueous solution of this dye was 615 nm.

In the light-sensitive material of the present invention, the dye represented by the foregoing general formula (I) can be incorporated into either a silver halide photographic emulsion layer or into a light-insensitive layer comprising a hydrophilic colloidal layer. A light-insensitive layer containing the dye can be positioned farther from the support than the photographic emulsion layer, between the photographic emulsion layer and the support, or on the opposite side of the support to the photographic emulsion layer.

The dyed light-insensitive layers can be any of a filter layer, an antihalation layer and a colored layer for other purposes.

In the light-sensitive material of the present invention, a single photographic emulsion layer or a plurality of photographic emulsion layers can be employed, and a single photographic emulsion layer or another hydrophilic colloidal layer containing the dye or a plurality of photographic emulsion layers or other hydrophilic colloidal layers containing the dye can be employed.

As the hydrophilic colloid forming the light-sensitive material of the present invention, not only gelatin (either lime-processed or acid-processed) can be used but also gelatin deriatives (such as gelatin derivatives prepared by reacting gelatin with aromatic sulfonyl chlorides, acid chlorides, acid anhydrides, isocyanates, 1,4-diketones or the like as described in U.S. Pat. No. 2,614,928; gelatin derivatives prepared by reacting gelatin with trimellitic acid anhydride described in U.S. Pat. No. 3,118,766; gelatin derivatives prepared by reacting gelatin with an organic acid containing an active halogen described in Japanese Patent Publication No. 5,514/64; gelatin derivatives prepared by reacting gelatin with aromatic glycidyl ethers described in Japanese Patent Publication No. 26,845/67; gelatin derivatives prepared by reacting gelatin with maleimide, maleamic acid, unsaturated aliphatic diamides or the like described in U.S. Pat. No. 3,186,846; sulfoalkylated gelatin described in British Pat. No. 1,033,189; polyoxyalkylene derivatives of gelatin described in U.S. Pat. No. 3,312,553; high molecular weight grafted products of gelatin prepared by, for example grafting to gelatin acrylic acid, methacrylic acid, the ester derivatives thereof with mono- or poly-hydric alcohols, the amide derivatives thereof, acrylo (or methacrylo)nitrile, styrene or like vinyl monomers individually or in combination); and synthetic hydrophilic high molecular weight materials such as homopolymers of vinyl alcohol, N-vinylpyrrolidone, hydroxyalkylmethacrylates, hydroxyalkylacrylates, methacrylamide, acrylamide, N-substituted methacrylamides, N-substituted acrylamides or like monomers or copolymers of these monomers, copolymers of these monomers and methacrylates, acrylates, vinyl acetate, styrene or the like, copolymers of any of the above-described monomers and maleic anhydride, maleamic acid or the like; naturally occurring hydrophilic high molecular weight materials other than gelatin (e.g., casein, agar-agar, alginic acid, polysaccharides, etc.), individually or in combination, can be used.

In the photographic light-sensitive material of the present invention, the dyes can be incorporated in a hydrophilic colloid layer in a usual manner. That is, in dyeing a photographic emulsion layer, an aqueous dye solution of a suitable concentration is added to a silver halide photographic emulsion solution prior to coating or, in dyeing a light-insensitive layer, an aqueous dye solution is added to an aqueous solution of a hydrophilic colloid, and these solutions are coated on a support or a layer of the photographic light-sensitive material in a well known manner.

The amount of dye employed in a photographic emulsion or other hydrophilic colloidal aqueous solution can be selected within the solubility of the dye depending upon the end-use purpose. Generally, about 5 to 200 mg/m$^2$ is employed.

In order to coat a hydrophilic colloidal layer containing the dye of the present invention, various coating methods can be employed including a dip coating method (including a dip coating method using an air knife in combination), a curtain coating method, and an extrusion coating method (including, for example, the method using a hopper described in U.S. Pat. No. 2,681,294). Two or more layers can be coated at the same time according to the method described in U.S. Pat. Nos. 2,761,791, and 2,941,898.

Other conventionally known water-soluble dyes as well as the water-soluble dye in accordance with the present invention can be incorporated in the emulsion layer and in the other hydrophilic colloidal layer of the light-sensitive material within a range such that the effect of the present invention is not substantially destroyed, e.g., in an amount of 0 to about 70 mg/m$^2$. In particular, where a single dye fails to provide the desired absorption characteristics, it is advantageous to use two or more dyes in combination. The hydrophilic colloidal layer can contain an emulsion dispersion of a water-insoluble dye. For example, the dispersion described in Japanese Patent Publication No. 18,459/66 can be used. Also, in the hydrophilic colloidal layer can be incorporated a pigment removable during the photographic processing steps such as manganese dioxide, colloidal silver, etc.

The layer to be colored according to the present invention can contain a high molecular weight mordant together with a hydrophilic colloid. For example, polymers derived from ethylenically unsaturated compounds and containing dialkylaminoalkyl ester residues as described in British Pat. No. 685,475; copolymers thereof described in U.S. Pat. No. 2,839,401; maleic anhydride copolymers or the derivatives thereof described in British Pat. No. 906,083; polymers obtained by the reaction between a polyvinylalkylketone and aminoguanidine as described in British Pat. No. 850,281; polymers having 2-methylimidazole nuclei as a side chain as described in U.S. Pat. No. 3,445,231; addition polymers of bisacrylamide and a secondary diamine or the quaternary salts thereof as described in Japanese Patent Application (OPI) No. 24,733/73; ternary or quaternary polymers containing polyvinylpyridine or polyvinylquinoline as described in British Pat. No. 765,520 and 766,202; polymers described in West German Patent Application No. OLS 1,914,361 and 1,914,362; and other various polymers known as mordants for acid dyes suitable for a light-sensitive material can be used.

In the present invention, at least one photographic emulsion layer can be spectrally sensitized with a methine dye. Suitable dyes which can be used include cyanine dyes, merocyanine dyes, composite cyanine dyes, composite merocyanine dyes, holopolar cyanine dyes, hemicyanine dyes, and styryl dyes. Particularly useful dyes for use in the invention are cyanine dyes, merocyanine dyes and composite merocyanine dyes. As the basic heterocyclic nucleus forming the molecules of these dyes, all nuclei commonly used for cyanine dyes can be used. That is, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, a nucleus in which an alicyclic hydrocarbon ring is fused to the above-described nucleus, and a nucleus in which an aromatic hydrocarbon ring is fused to the above-described nucleus, i.e., an indolenine nucleus, a benzindolenine nucleus, a benzopyrrole nucleus, a benzoxazole nucleus, a naphthoxazole nucleus, a benzothiazole nucleus, a naphthothiazole nucleus, benzoselenazole nucleus, a naphthoselenazole nucleus, a benzimidazole nucleus, a naphthoimidazole nucleus, a quinoline nucleus, and the like can be used. These nuclei can be substituted with a substituent such as an alkyl group, an alkoxy group, a hydroxy group, a carboxy group, an alkoxycarbonyl group, an acyl group, an amino group, an alkylamino group, a dialkylamino group, an acylamino group (including an alkylsulfonylamino group), a substituted alkyl group (e.g., a haloalkyl group such as a trifluoromethyl group, etc.), an aryl group (e.g., a phenyl group, a naphthyl group, etc.), a cyano group or a halogen atom (e.g., a chlorine atom, etc.).

With merocyanine dyes or composite merocyanine dyes, a 5- or 6-membered heterocyclic nucleus containing a ketomethylene bond, such as a pyrazolin-5-one nucleus, a pyrazolidine-3,5-dione nucleus, a hydantoin nucleus, a thiohydantoin nucleus, a 2-thiaoxazolidine-2,4-dione nucleus, a thiazolidine-2,4-dione nucleus, a rhodanine nucleus, a thiobarbituric acid nucleus, and the like can be used as an acid nucleus forming the dye molecule.

Where composite merocyanine dyes are used, the dye molecules can comprise various combinations such as a combination of two basic nuclei and one acidic nucleus, a combination of one basic nucleus and two acidic nuclei, and a combination of two basic nuclei and two acidic nuclei.

These sensitizing dyes can be used individually or in combination. A large number of examples is known, for the purpose of supersensitization, of the combined use of sensitizing dyes.

In addition to the sensitizing dyes, substances which show a supersensitizing action without any substantial absorption of visible light such as compounds containing a pyrimidinylamino group or a triazinylamino group, described in U.S. Pat. Nos. 2,933,390, 3,511,644, 3,615,613, 3,615,632, 3,615,641, etc., aromatic organic acid-formaldehyde condensates described in British Pat. No. 1,137,580, azaindenes, cadmium salts, or the like can be incorporated in the emulsion.

The light-sensitive material of the present invention can possess a spectrally sensitized emulsion layer or layers and a spectrally non-sensitized emulsion layer or layers at the same time, with the spatial relationship of the layers in the light-sensitive material being varied as the occasion demands.

Various additives having various functions for enhancing the quality of the photographic light-sensitive materials such as a hardener, a coating aid, a plasticizer, a slipping agent, a matting agent, an emulsion polymerized latex, an antistatic agent, an ultraviolet light absorbing agent, an antioxidant, and the like can be incorporated in the hydrophilic colloidal layer of the light-sensitive material of the present invention. These additives are described below.

In the light-sensitive material of the present invention, photographic emulsion layers and other hydrophilic colloidal layers can be hardened by adding a conventionally used hardener. Various kinds of compounds, individually or in combination, such as aldehydes (e.g., glyoxal described in U.S. Pat. No. 1,870,354, glutaraldehyde described in British Pat. No. 825,544, etc.), N-methylol compounds (e.g., N,N'-dimethylolurea, dimethylolhydantoin described in British Pat. No. 676,628, etc.), dioxane derivatives (e.g., dihydroxydioxane described in U.S. Pat. No. 3,380,829, derivatives thereof described in Japanese Patent Publication No. 38,713/71, etc.), epoxy group-containing compounds (e.g., compounds described in U.S. Pat. Nos. 3,047,394, 3,091,537, Japanese Patent Publication No. 7,133/59, etc.), compounds containing reactive halogens (e.g., 2,4-dichloro-6-hydroxy-1,3,5-triazine, described in U.S. Pat. No. 3,325,287), mucohalic acids (e.g., mucochloric acid described in U.S. Pat. No. 2,080,019, mucobromic acid, the derivative thereof described in Japanese Patent Publication No. 1,872/71, etc.), bis(methanesulfonic acid ester) described in U.S. Pat. No. 2,726,162, sulfonyl compounds (e.g., bis(benzenesulfonyl chloride)described in U.S. Pat. No. 2,725,925, etc.), aziridine compounds (e.g., compounds described in Japanese Patent Publication Nos. 4,212/58 and 8,790/62, etc.), divinylsulfones (e.g., compounds described in U.S. Pat. No. 2,579,871, etc.), compounds containing a reactive olefin bond (e.g., divinylketones as described in German Pat. No. 872,153, compounds containing an acryloyl group described in U.S. Pat. Nos. 3,255,000, 3,635,718, British Pat. No. 944,869, West German Pat. No. 1,090,427, etc.), alkylenebismaleimides described in U.S. Pat. Nos. 2,992,109, etc.), isocyanates described in U.S. Pat. No. 3,103,437, carbodiimides described in U.S. Pat. No. 3,100,704, isoxazole derivatives (e.g., compounds described in U.S. Pat. Nos. 3,321,313, 3,543,292, etc.), carbamoyl chloride derivatives described in Japanese Patent Publication No. 6,899/66, high molecular weight hardeners (e.g., dialdehyde starch described in U.S. Pat. No. 3,057,723, compounds described in Japanese Patent Publication No. 12,550/67, etc.), inorganic hardeners (e.g., chromium alum, chromium acetate, zirconium sulfate, etc.), and the like can be used as the hardener.

The photographic emulsion layers and other hydrophilic colloidal layers in the light-sensitive material of the present invention can contain various known surface active agents as a coating aid or for antistatic purposes, improvement of sliding properties and other purposes. For example, nonionic surface active agents such as saponin, polyethylene glycol, polyethylene glycol-polypropylene glycol condensates described in U.S. Pat. No. 3,294,540, polyalkylene glycol ethers described in U.S. Pat. No. 2,240,472 and 2,831,766, polyalkylene glycol esters, polyalkylene glycol amides, and the like; anionic surface active agents such as alkylcarboxylic acid salts, alkylsulfonic acid salts, alkylbenzenesulfonates, alkylnaphthalenesulfonates, alkylsulfates, N-acylated N-alkyltaurines described in U.S. Pat. No. 2,739,891, maleopimelates described in U.S. Pat. Nos. 2,359,980, 2,409,930, and 2,447,750, the compounds described in U.S. Pat. Nos. 2,823,123 and 3,415,649, and the like; and amphoteric surface active agents such as the compounds described in British Pat. No. 1,159,825, Japanese Patent Publication No. 378/65, Japanese Patent Application (OPI) No. 43,924/73, U.S. Pat. No. 3,726,683, etc., can be used.

The hydrophilic colloidal layers in the light-sensitive material of the present invention can contain a slipping agent such as the higher alcohol esters of higher fatty acids described in U.S. Pat. Nos. 2,588,756 and 3,121,060; casein described in U.S. Pat. No. 3,295,979, higher fatty acid calcium salts described in British Pat. No. 1,263,722, silicone compounds described in British Pat. No. 1,313,384, U.S. Pat. Nos. 3,042,522 and 3,489,567. A dispersion of liquid paraffin can also be used for this purpose.

The photographic emulsion layers and other hydrophilic colloidal layers in the light-sensitive material of the present invention can contain a plasticizer such as glycerin, diols described in U.S. Pat. No. 2,960,404, trihydric aliphatic alcohols described in U.S. Pat. No. 3,520,684, or the like.

The photographic emulsion layers and other hydrophilic colloidal layers in the light-sensitive material of the present invention can contain a dispersion of a water-insoluble synthetic polymer or of a polymer slightly soluble in water for the purpose of improving the dimensional stability and the like. For example, polymers containing as a monomer alkyl acrylates, alkyl methacrylates, alkoxy acrylates, alkoxy methacrylates, glycidyl acrylate, glycidyl methacrylate, acrylamide, methacrylamide, vinyl acetate, acrylonitrile, olefins or styrene, individually or in combination, or containing these monomers and acrylic acid, $\alpha,\beta$-unsaturated dicarboxylic acids, sulfoalkyl acrylates, styrenesulfonic acid or the like can be used. As specific examples, there are illustrated the polymers described in U.S. Pat. Nos. 2,376,055, 3,607,290, 3,645,740, British Pat. Nos. 1,186,699, 1,307,373, U.S. Pat. Nos. 3,062,674, 2,739,137, 3,411,911, 3,488,708, 3,635,715, 2,853,457.

The hydrophilic colloidal layers in the light-sensitive material of the present invention can contain a matting agent such as inorganic particles, e.g., silica described in Swiss Pat. No. 330,158, glass powder described in French Pat. No. 1,296,995, carbonates of alkaline earth metals, cadmium or zinc described in British Pat. No. 1,173,181; starch described in U.S. Pat. No. 2,322,037; and organic particles, e.g., starch derivatives described in Belgian Pat. No. 625,451 or British Pat. No. 981,198; polyvinyl alcohol described in Japanese Patent Publication No. 3,643/69, polystyrene or polymethyl methacrylate described in Swiss Pat. No. 330,158, polyacrylonitrile described in U.S. Pat. No. 3,079,257 and polycarbonates described in U.S. Pat. No. 3,022,169.

The photographic emulsion layers and other hydrophilic colloidal layers in the light-sensitive material of the present invention can contain an ultraviolet light-absorbing agent such as the compounds of benzophenone series, the benzotriazole series, the thiazolidine series or the like. These ultraviolet light-absorbing agents can be mordanted to a specific layer in the same manner as with the dyes.

The photographic emulsion layers and other hydrophilic colloidal layers in the light-sensitive material of the present invention can contain a brightening agent of the stilbene series, the triazine series, the oxazole series, the coumarin series or the like. Water-soluble compounds can be used and, in addition, water-insoluble brightening agents can be used in the form of a dispersion.

The hydrophilic colloidal layers in the light-sensitive material of the present invention can contain compounds used for the purpose of preventing color fog of color light-sensitive materials or preventing color mixing between layers, such as alkylhydroquinones, dialkylhydroquinones, aryl-substituted hydroquinones, sulfo-substituted hydroquinones, high molecular weight compounds containing hydroquinone residues, catechol derivatives, aminophenol derivatives, gallic acid derivatives, ascorbic acids or the like in the form of, if necessary, a dispersion. Specific examples of these compounds are the compounds described in British Pat. Nos. 557,750, 557,802, U.S. Pat. Nos. 2,336,327, 2,360,290, 2,403,721, 2,728,659, 2,732,300, 2,735,765, 2,418,613, 2,675,314, 2,710,801, 2,816,028, 2,360,290, French Pat. No. 885,982, U.S. Pat. Nos. 2,336,327, 2,403,721, British Pat. No. 1,133,500, Japanese Patent Publication No. 13,496/68, U.S. Pat. Nos. 3,457,079, 2,360,290, and 2,384,658. In order to introduce these compounds into the hydrophilic colloid layer, a method of dispersion in a hydrophilic colloid together with a high-boiling organic solvent such as an aliphatic ester, an aromatic carboxylic acid alkyl ester, an aromatic phosphoric acid ester, an aromatic ether, or the like, a method of addition as an alkaline aqueous solution to a hydrophilic colloid, and a like method can be employed.

The silver halide photographic emulsion to be used for the light-sensitive material of the present invention can be prepared using various conventionally known techniques depending upon the end-use of the light-sensitive material so as to provide suitable characteristics.

Any of silver chloride, silver chlorobromide, silver bromide, silver bromoiodide, silver chlorobromoiodide and the like can be used as the silver halide, and the halogen content ratio is not particularly limited. As a protective colloid used upon formation of the silver halide, gelatin derivatives such as acylated gelatin (e.g., phthaloylated gelatin, succinoylated gelatin, etc.) and grafted gelatin prepared by grafting acrylamide or hydroxyalkyl (meth)acrylates; and high polymers such as a copolymer comprising three monomers, acrylic acid (or methacrylic acid), acrylamide (or methacrylamide) and an amine derivative of either of them (for example, N-(dialkylaminoalkyl)-acrylamide), individually or in combination, as well as gelatin commonly used, can be employed.

Known processes can be employed for preparing the silver halide emulsion. For example, the principles and processes described in C. E. K. Mees & T. H. James, *The Theory of the Photographic Process*, 3rd Ed., Macmillan Co., New York (1966); P. Grafkides, *Chimie Photograhique*, 2nd Ed., Photocinema Paul Montel, Paris (1957); H. Frieser, *Die Grundlagen der Photographische Prozesse mit Silberhalogeniden*, Vol. 2, pp. 609 – 674 and 735 – 743, Akademische Verlaggesellschaft, Frankfurt-am-Main, (1968); and the like can be used. Any of an acidic process, a neutral process and an ammoniacal process can be used, and a single jet or a double jet process (also called a twin jet process) can be used. The so-called controlled double jet process as described in *Berichte der Bunsengesellschaft fur Physikalische Chemie*, Band 67, p. 349 et seq., (1963) can be used as the occasion demands. Such a process is advantageous for obtaining an emulsion having an extremely narrow particle size distribution. The silver halide grains can be in any of a cubic form, an octahedral form, a tetradecahedral form (both of the foregoing two forms coexisting), various twin forms or in a mixed form thereof. The silver halide emulsion can contain either coarse grains or fine grains, with the mean value of grain diameter or edge length (or a corresponding value showing the grain size) (numerical average measured according to a projection method) being less than about 0.2 $\mu$m, about 0.2 to 1 $\mu$m, and more than about 1 $\mu$m. The grain size distribution (with the grain size being in the sense as described above) can be either narrow or braod. The silver halide emulsion can be either physically ripened or not physically ripened. Usually, the soluble salts are removed from the emulsion after the formation of precipitate or after physical ripening. As the means for salt removal, a noodle washing method, long well known, or a floculation method utilizing inorganic salts containing a multivalent anion (e.g., ammonium sulfate, etc.), anionic surface active agents, anionic polymers (e.g., polystyrenesulfonic acid, etc.) or gelatin derivatives (e.g., aliphatic or aromatic acylated gelatin, etc.) can be employed.

As the silver halide emulsion, an emulsion which has not been chemically sensitized (so-called non-after-ripened emulsion) can be used, although the emulsion can be chemically sensitized. Suitable processes for chemical sensitization include the processes described in Mees & James, supra, Grafkides, supra, or Frieser, supra, and other various known processes. That is, sulfur sensitization using the compounds containing a sulfur capable of reacting with silver ion such as a thiosulfate or the compounds described in U.S. Pat. Nos. 1,574,944, 2,278,947, 2,410,689, 3,189,458, 3,501,313, French Pat. No. 2,059,245 or using active gelatin; reduction sensitization using a reducing agent such as stannous chloride described in U.S. Pat. No. 2,487,850, amines described in U.S. Pat. Nos. 2,518,698, 2,521,925, 2,521,926, 2,419,973 and 2,419,975, iminoaminomethanesulfinic acid described in U.S. Pat. No. 2,983,610 or silane compounds described in U.S. Pat. No. 2,694,639, or according to the process described in H. W. Wood, *Journal of Photographic Science*, Vol. 1, p. 163 et seq. (1953); gold sensitization using a gold complex salt described in U.S. Pat. No. 2,399,083 or gold-thiosulfate complex salt; sensitization using salts of noble metals such as platinum, palladium, iridium, rhodium, ruthenium described in U.S. Pat. Nos. 2,448,060, 2,540,086, 2,566,245 and 2,566,263, individually or in combination, can be employed. Also, selenium sensitization described in U.S. Pat. No. 3,297,446 can be used in place of of together with the sulfur sensitization.

The photographic emulsions in the light-sensitive material of the present invention can contain various additives for the purpose of preventing fog or stabilizing the photographic properties during production steps, during storage of the light-sensitive material or during development processing. That is, azoles (e.g., benzotriazole, benzothiazolium salts described in U.S. Pat. No. 2,131,038, aminobenzimidazole described in U.S. Pat. No. 2,324,123, etc.); nitroazoles (e.g., nitrobenzindazole, nitrobenzotriazole, nitrobenzimidazoles described in British Pat. No. 403,789, nitroaminobenzimidazoles described in U.S. Pat. No. 2,324,123, etc.); halogen-substituted azoles (e.g., 5-chlorobenzimidazole, 5-bromoimidazole, 6-chlorobenzimidazole, etc.); mercaptoazoles (e.g., mercaptothiazole derivatives described in U.S. Pat. No. 2,824,001, mercaptobenzothiazole, the derivatives thereof described in U.S. Pat. No. 2,697,099, mercaptoimidazole derivatives described in U.S. Pat. No. 3,252,799, mercaptobenzimidazole, mercaptoxadiazole described in U.S. Pat. No. 2,843,491, mercaptothiadiazole described in U.S. Pat. No. 1,758,576, phenylmercaptotetrazole described in U.S. Pat. No. 2,403,927, etc.); mercaptopyrimidine described in U.S. Pat. No. 2,304,962; mercaptotriazine described in U.S. Pat. No. 2,476,536; mercaptotetrazaindene described in British Pat. No. 893,428; various mercapto compounds (e.g., thiosalicylic acid described in U.S. Pat. No. 2,377,375, thiobenzoic acid described in U.S. Pat. No. 3,226,231, sugar mercaptal described in Japanese Patent Publication No. 8,743/72, etc.); oxazolinethione described in U.S. Pat. No. 3,251,691; triazolothiadiazole described in Japanese Patent Publication No. 17,932/68; and the like can be added. Also, nitrogen-containing heterocyclic compounds having an antifogging action such as azaindene compounds (e.g., tetrazaindenes such as the compounds described in U.S. Pat. Nos. 2,444,605, 2,444,606, 2,450,397, Japanese Patent Publication Nos. 10,166/64, 10,516/67; pentazaindenes such as the compounds described in U.S. Pat. No. 2,713,541, Japanese Patent Publication No. 13,495/68), urazole compounds described in U.S. Pat. No. 2,708,161, etc., can be employed. Also, benzenesulfinic acid described in U.S. Pat. No. 2,394,198, benzenethiosulfonic acid, benzenesulfinic acid amide described in Japanese Patent Publication No. 4,136/68, sugar mercaptal described in Japanese Patent Publication No. 8,743/72, and the like can be added. Further, various chelating agents described in U.S. Pat. No. 2,691,588, British Pat. No. 623,488, Japanese Patent Publication Nos. 4,941/68 and 13,496/68 can be added for preventing fog due to metal ions.

The photographic emulsion layers or other hydrophilic colloidal layers in the light-sensitive material of the present invention can contain, for example, polyalkylene oxides described in U.S. Pat. No. 2,441,389, the ethers, esters and amides of polyalkylene oxides described in U.S. Pat. No. 2,708,161, other polyalkylene oxide derivatives described in British Pat. No. 1,145,186, Japanese Patent Publication Nos. 10,989/70, 15,188/70, 43,435/71, 8,106/72 and 8,742/72, thioether compounds described in U.S. Pat. Nos. 3,046,132 – 3,046,135 or Japanese Patent Publication Nos. 9,019/70 and 11,119/72, thiomorpholines described in Japanese Patent Publication No. 28,325/72, quaternary ammonium compounds described in U.S. Pat. No. 3,772,021, pyrrolidines described in Japanese Patent Publication No. 27,037/70, urethane or urea derivatives described in Japanese Patent Publication No. 23,465/65, imidazole derivatives described in Japanese Patent Publication No. 45,541/72, polymers described in Japanese Patent Publication No. 26,471/70, 3pyrazolidones described in Japanese Patent Publication No. 27,670/70, for the purpose of increasing the sensitivity, enhancing the contrast or accelerating the development.

To the photographic emulsions of the light-sensitive material of the present invention can be added inorganic or organic mercury compounds for sensitizing or antifogging purposes. For example, mercury complex salts described in U.S. Pat. No. 2,728,664, benzothiazole mercury salts described in U.S. Pat. No. 2,728,667, mercury salt adducts described in U.S. Pat. Nos. 2,728,663 and 2,732,302, organic mercury compounds described in U.S. Pat. Nos. 2,728,665 and 3,420,668 can be used.

Where the silver halide grain size is particularly small (less than about 0.4 $\mu$m or less than about 0.2 $\mu$m), the compounds described in, e.g., British Pat. Nos. 1,316,493, 1,317,138, 1,317,139, 1,317,709, 1,297,901 and West German Patent Application No. OLS 2,235,031 can be added as a sensitizing agent to the photographic emulsions of the light-sensitive material of the present invention.

The photographic emulsion layers in the light-sensitive material of the present invention can contain a conventionally used, non-diffusible, dye image-forming coupler. A dye imageforming coupler (hereinafter abbreviated "color coupler") is a compound capable of forming a dye image by reaction, upon photographic development, with an oxidation product of an aromatic primary amine developing agent. The color couplers can be either a 4-equivalent type or a 2-equivalent type or, also, they can be colored couplers for color correction or couplers capable of releasing a development inhibitor. As a yellow-forming coupler, there can be usefully used open-chain ketomethylene type compounds such as acylaminoacetamide compounds, as a magentaforming coupler, pyrazolone compounds or cyanoacetyl compounds and, as a cyan-forming coupler, naphtholic or phenolic compounds. Couplers can be introduced into the photographic emulsion layers using methods commonly employed for multi-color light-sensitive materials.

The present invention can also be applied to a multilayer photographic material comprising a support having thereon at least two light-sensitive layers having a different spectral sensitivity. Multi-layer color photographic materials usually comprise a support having thereon at least one red-sensitive silver halide emulsion layer, one green-sensitive silver halide emulsion layer and one blue-sensitive silver halide emulsion layer. The sequence of these layers can be optionally selected as required. Usually the red-sensitive silver halide emulsion layer is combined with a cyan-forming coupler, the green-sensitive silver halide emulsion layer with a magenta-forming coupler, and a blue-sensitive silver halide emulsion layer with a yellow-forming coupler, although different combinations can be used in certain cases.

The photographic emulsion layers and other hydrophilic colloidal layers in the light-sensitive material of the present invention can contain, individually or in combination, developing agents such as aromatic diols (e.g., hydroquinone, etc.), aminophenols, phenylenediamines, 3-pyrazolidones, ascorbic acid or derivatives thereof. The combination of hydroquinone and an N-hydroxyalkyl-substituted p-aminophenol derivative described in Japanese Patent Publication No. 43,814/73 is particularly advantageous. When the developing agents are water-insoluble, they can be added as a dispersion.

As a support, there can be used either transparent or opaque supports usually used for photographic elements such as glass plates comprising soda glass, potash glass, borosilicate glass, quartz glass, or like glass; films comprising synthetic high polymers of polyalkyl acrylates, polyalkyl methacrylates, polystyrene, polyvinyl chloride, partially formalated polyvinyl alcohol, polycarbonate, polyesters (e.g., polyethylene terephthalate, etc.) or polyamides; films comprising cellulose derivatives (e.g., cellulose nitrate, cellulose acetate, cellulose acetate butyrate, etc.); paper; baryta-coated paper; $\alpha$-olefin polymer-coated paper; synthetic papers comprising polystyrene or the like; ceramics; metal; and the like.

The photographic emulsion layers and other layers of the light-sensitive material of the present invention can be coated according to various known coating methods. Suitable coating methods include a dip coating method, an air knife coating method, a roller coating method, a curtain coating method and an extrusion coating method. The method described in U.S. Pat. No. 2,681,294 is an advantageous method. Also, two or more layers can be coated at the same time using the method described in, e.g., U.S. Pat. Nos. 2,761,791 and 3,526,528.

The light-sensitive material of the present invention can contain an antistatic layer or an electrically conductive layer, e.g., a metal layer formed by vacuum evaporation or electrodeposition or an ionic polymer.

All known processes can be used for the photographic processing of the light-sensitive material of the present invention. Known solutions can be used as the processing solution, with the processing temperatures being less than about 18° C, about 18° C to about 50° C and higher than about 50° C.

To the light-sensitive material of the present invention can be applied any development processings for forming silver images (black-and-white photographic processing) and color photographic processings (development processing for forming a dye image).

In the case of subjecting the light-sensitive material of the present invention to a black-and-white photographic processing, the developer used can contain a known developing agent. As the developing agent, there can be used, individually or in combination, dihydroxybenzenes (e.g., hydroquinone, chlorohydroquinone, bromohydroquinone, 2,3-dichlorohydroquinone, methylhydroquinone, isopropylhydroquinone, 2,5-dimethylhydroquinone, etc.), 3-pyrazolidones (e.g., 1-phenyl-3-pyrazolidone, 1-phenyl-4-methyl-3-pyrazolidone, 1-phenyl-4,4-dimethyl-3-pyrazolidone, 1-phenyl-4-ethyl-3-pyrazolidone, 1-phenyl-5-methyl-3-pyrazolidone, etc.), aminophenols (e.g., o-aminophenol, p-aminophenol, N-methyl-o-aminophenol, N-methyl-p-aminophenol, 2,4-diaminophenol, etc.), pyrogallol, ascorbic acid, 1-aryl-3-pyrazolines (e.g., 1-(p-hydroxyphenyl)-3-aminopyrazoline, 1-(p-methylaminophenyl)-3-aminopyrazoline, 1-(p-aminophenyl)-3-aminopyrazoline, 1-(p-amino-m-methylphenyl)-3-aminopyrazoline, etc.) and the like.

To the developer can be added, if desired, a preservative (e.g., sulfites, bisulfites, ascorbic acid, etc.), an alkali agent (e.g., hydroxides, carbonates, etc.), a pH buffer e.g., carbonates, borates, boric acid, acetic acid, citric acid, alkanolamines, etc.), a dissolving aid (e.g., polyethylene glycols, the esters thereof, alkanolamines, etc.), a sensitizing agent (e.g., nonionic surface active agents containing a polyoxyethylene chain, quaternary ammonium compounds, etc.), a surface active agent, an antifogging agent (e.g., halides such as potassium bromide and sodium bromide, nitrobenzindazole, nitrobenzimidazole, benzotriazole, benzothiazole, tetrazoles, thiazoles, etc.), a chelating agent (e.g., ethylenediaminetetraacetic acid or the alkali metal salts thereof, nitrilotriacetate, polyphosphates, etc.), a development accelerator (e.g., the compounds described in U.S. Pat. No. 2,304,025 and Japanese Patent Publication No. 45,541/72, etc.), a hardener (e.g., glutaraldehyde, etc.), and the like.

A so-called "lith-type" development processing can be applied to the light-sensitive material of the present invention. "Lith-type" development processing means a development processing in which the development is conducted in an infectious manner under a low sulfite ion concentration using usually dihydroxybenzenes as a developing agent, for the photographic reproduction of line images or the photographic reproduction of half tone images through half tone dots. The details of such are described in Mason, *Photographic Processing Chemistry*, pp. 163 – 165 (1966).

As a special type of development processing, a process of incorporating a developing agent in a light-sensitive material (for example, in an emulsion layer) and processing the light-sensitive material in an alkaline aqueous solution to effect development can be employed. This type of development processing is often utilized as one system of rapidly processing a light-sensitive material in combination with a silver salt-stabilizing processing using a thiocyanate or the like and, in the present invention too, such processing is possible.

As the fixing solution, a fixing solution of a generally used composition can be used. A fixing solution is generally an aqueous solution comprising a fixing agent, a hardener and other additives, the pH of the solution being usually about 3.8 to 5.0. Organic sulfur compounds, well known as fixing agents, capable of producing a soluble stable silver complex salt, as well as thiosulfates (e.g., sodium thiosulfate, potassium thiosulfate, ammonium thiosulfate, etc.) and thiocyanates (e.g., sodium thiocyanate, potassium thiocyanate, ammonium thiocyanate, etc.) can be used as the fixing agent.

A water-soluble aluminum salt, functioning as a hardener, such as aluminum chloride, aluminum sulfate, potassium alum, etc., is generally added to the fixing solution.

The dye images are formed in a conventional manner. For example, the negative-positive process as described in *The Journal of the Society of Motion Picture and Television Engineers*, *61*, pp. 667 – 701 (1953); a color reversal process comprising imagewise exposure, forming a negative silver image by developing with a developer containing a black-and-white developing agent, a uniform exposure (or other suitable fogging processing) at least one time, and subsequently conducting color development to form a dye positive image; a process using a direct positive emulsion to obtain a dye positive image; and the like can be employed.

A color developer generally comprises an alkaline aqueous solution containing a color developing agent. Examples of color developing agents include known primary aromatic amine developing agents, for example, phenylenediamines (e.g., N,N-diethyl-p-phenylenediamine, N-ethyl-N-(β-hydroxyethyl)amino-2-methylaniline, 4-(N-ethyl-N-β-methanesulfonamidoethyl)amino-2-methylaniline, N,N-diethylamino-2-ethoxyaniline, etc.), p-aminophenols (e.g., 4-aminophenol, 2,6-dichloro-4-aminophenol, 2-bromo-4-aminophenol, etc.), and the like. The color developer can further contain common additives such as alkali metal sulfites, carbonates, bisulfites, bromides, iodides, alkaline buffers, etc. Further, if desired, a dye-forming coupler, a competitive coupler, an anti-fogging agent, a hardener, an antioxidant, a thickening agent, and the like can be added.

According to the present invention, when a dyecontaining hydrophilic layer is provided on a light-sensitive material for the purpose of filtering, antihalation or the like or when a dye is incorporated in a photographic emulsion layer, the photographic emulsion layers which have not been spectrally sensitized are not spectrally sensitized by the dye incorporated therein or diffused from other layers. When spectral sensitization is achieved with conventional dyes, sensitization occurs in many cases in a different wavelength region (generally toward the longer side) from the absorption wavelength region of the free dye. Hence the spectral sensitization due to the dyes is not cancelled out and the photographic emulsion layers are provided with a sensitivity in a wavelength region longer than the intrinsic sensitivity region of the silver halide. Thus, the use of light of a long wavelength as a safe light illumination for handling photographic light-sensitive materials in a dark room is difficult. However, the light-sensitive material of the present invention does not have this inconvenience. Therefore, the light-sensitive material of the present invention can be handled under a safe light illumination of a light containing light components of wavelengths other than the intrinsic sensitivity region of silver halide close to the safe light source for quite a long period of time without producing light fog due to the safe light illumination.

According to the present invention, when a dye-containing hydrophilic colloidal layer is provided on a light-sensitive material for the purpose of filtering, antihalation or the like, or when a dye is incorporated in the photographic emulsion layers, a deterioration of the spectral sensitization characteristics of the spectrally sensitized photographic emulsion layers can be avoided. That is, undesirable changes in the spectral sensitivity characteristics such as a reduction in the spectral sensitivity of the photographic emulsion layers, a shift of the sensitization maximum wavelength, an expansion or a narrowing of the spectral sensitization region and the like due to the dye incorporated in a spectrally sensitized photographic emulsion layer or the dye diffused from other layers do not occur. Therefore, light-sensitive materials having good color sensitivity or color reproducibility can be easily obtained. Also, the wavelength region for safe light illumination can be easily selected from a wavelength region other than the intrinsic sensitivity region of the silver halide and the spectrally sensitized region.

With a color light-sensitive material wherein the spectral sensitivity property of the respective emulsion layers corresponding to the three primary colors is important, control, after making the spectral sensitivity characteristic of each emulsion layer as desirable as possible, of the spectral sensitivity characteristics utilizing the spectral absorption of a filter layer or an upper emulsion layer having a filtering function (for example, the method described in Japanese Patent Application (OPI) No. 30,321/72) is possible. In such case, if the spectral sensitivity characteristic of the emulsion layer itself is changed by the influence of dyes used for the filter layer or the like, it becomes very difficult to obtain the desired spectral characteristics. Application of the present invention makes it easy to obtain the desired spectral sensitivity characteristics by the combination of the spectral sensitization of an emulsion layer and the spectral absorption of a filter layer or the like.

The following examples are given to illustrate the present invention in greater detail.

EXAMPLE 1

To a silver bromoiodide gelatin photographic emulsion of a mean grain size of 0.7 $\mu$, prepared in a conventional manner (according to the process of Trivelli and Smith, described in *Photographic Journal*, Vol. 79, p. 230, (1939)), chemically sensitized with a sulfur compound and a gold compound and containing 1 mol% silver iodide was added a dye corresponding to Dye 3 described hereinbefore in an amount of $0.4 \times 10^{-3}$ mol per 1 kg of the emulsion for the purpose of improving the image sharpness. The resulting emulsion is hereinafter referred to as Emulsion A. On the other hand, an emulsion to which a well-known dye having the following structural formula

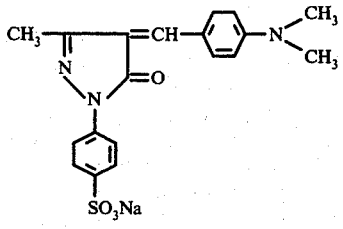

was added in an amount of $0.5 \times 10^{-3}$ mol per 1 kg of the emulsion in place of the above-described Dye 3 was prepared for comparison. This emulsion is hereinafter referred to as Emulsion B. Further, an emulsion to which no dye had been added was prepared. This emulsion is hereinafter referred to as Emulsion C.

Each of Emulsions A, B and C was coated on a subbed, 190 $\mu$-thick cellulose acetate film and dried. The resulting samples are referred to as Samples A, B and C corresponding to Emulsions A, B and C, respectively. A 20 W tungsten light was covered by Fuji Safe Light Filter No. 2B made by the Fuji Photo Film Co., Ltd. (the spectral transmission curve of which is shown in FIG. 1) to prepare a safe light test light source. The above-described Samples A, B and C were left for 20 minutes at a distance of 1 m from this test light source and, after development processing for 1 minute at 20° C using a developer having the following composition, were fixed, washed and dried in a conventional manner.

| | | |
|---|---|---|
| p-Methylaminophenol Sulfate | 1 | g |
| Sodium Sulfate (anhydrous) | 15 | g |
| Hydroquinone | 4 | g |
| Sodium Carbonate (monohydrate) | 27 | g |
| Potassium Bromide | 0.7 | g |
| Water to make | 1000 | cc |

The light fog density of each of the samples was as tabulated below.

| | |
|---|---|
| Sample A | 0.06 |
| Sample B | 0.24 |
| Sample C | 0.06 |

Fogging due to the safe light source did not occur with Sample A using the dye of the present invention as with dye-free Sample C, while considerable fogging occurred with Sample B using the known dye.

EXAMPLE 2

To the same silver bromoiodide emulsion as in Example 1 was added 3,3'-diethylthiazolinocarbocyanine bromide in an amount of $10^{-5}$ mol per mol of silver halide. To this emulsion was separately added two dyes as with Emulsion A and B to prepare Emulsions A' and B'. Also, dye-free Emulsion C' was prepared.

Coating of the emulsion and safe light test were conducted in the same manner as in Example 1. The light fog density of each sample was as follows.

| | |
|---|---|
| Sample A' | 0.07 |
| Sample B' | 0.28 |
| Sample C' | 0.12 |

Less safe light fogging occurred in Sample A' using the dye of the present invention than with dye-free Sample C'. In contrast, considerable safe light fogging occurred with Sample B' using the known dye.

EXAMPLE 3

To a silver chlorobromide emulsion of a mean grain size of 0.35 $\mu$ containing 30 mol% of silver bromide prepared using a simultaneous mixing process was added a sensitizing dye having the following structural formula

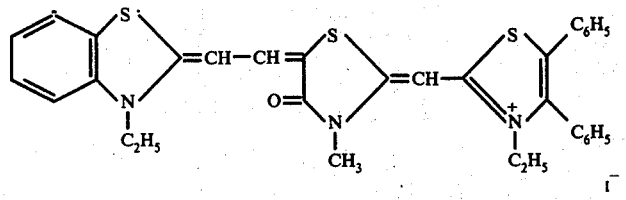

in an amount of $2 \times 10^{-5}$ mol per mol of silver halide. This emulsion was coated on a subbed, 0.18 mm-thick polyethylene terephthalate film in a dry thickness of 5 $\mu$.

On this emulsion layer was coated a solution of the following composition in an amount of 125 cc/m$^2$ as a protective layer, and dried. This sample was referred to as Sample $A_2$.

| | | |
|---|---|---|
| Gelatin | 10 | g |
| Dye 5 (described hereinbefore) | 3.5 | g |
| Sodium Dodecylsulfate (1 % aq. soln.) | 20 | cc |
| Water to make | 1000 | cc |

Similarly, a sample using a dye corresponding to the following structural formula

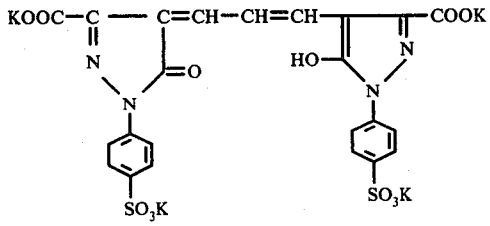

in place of Dye 5 was prepared, this sample being referred to as Sample $B_2$. Also, a dye-free sample was prepared, which was referred to as Sample $C_2$.

Figure 2:
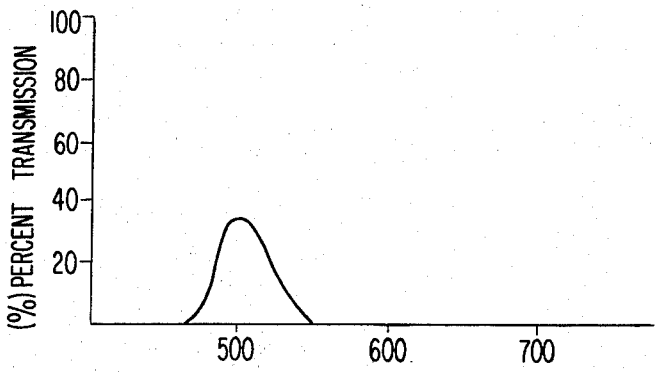
FIG. 2 shows the spectral transmission curve of a safe light filter used as the safe light test source in Example 2.

A 20 W tungsten bulb was covered by a safe light filter having the spectral transmission curve shown in FIG. 2 to prepare a safe light test light source. The above-described Samples $A_2$, $B_2$ and $C_2$ were left for 5 minutes at a distance of 1 m from this light source and, after development processing for 3 minutes at 20° C in a developer having the following composition, were fixed, washed and dried. In order to obtain development fog, the unexposed respective samples were similarly development-processed.

| | | |
|---|---|---|
| Sodium Sulfite (anhydrous) | 50 | g |
| Hydroquinone | 12 | g |
| Sodium Carbonate (anhydrous) | 60 | g |
| 1-Phenyl-3-pyrazolidone | 0.5 | g |
| Potassium Bromide | 2 | g |
| Benzotriazole | 0.2 | g |
| Water to make | 1000 | cc |

The fog density values of each sample measured using a P-type photographic densitometer made by the Fuji Photo Film Co., Ltd. were as follows.

| Sample | Exposed | Unexposed | Light Fog |
|---|---|---|---|
| | (a) | (b) | (a - b) |
| $A_2$ | 0.08 | 0.06 | 0.02 |
| $B_2$ | 0.56 | 0.06 | 0.50 |
| $C_2$ | 0.37 | 0.06 | 0.31 |

The safe light fog of Sample $B_2$ using the known dye was greater than that of dye-free Sample $C_2$. As is apparent from these samples, almost no light fog due to the safe light occurred in Sample $A_2$ in accordance with the present invention.

Figure 3:
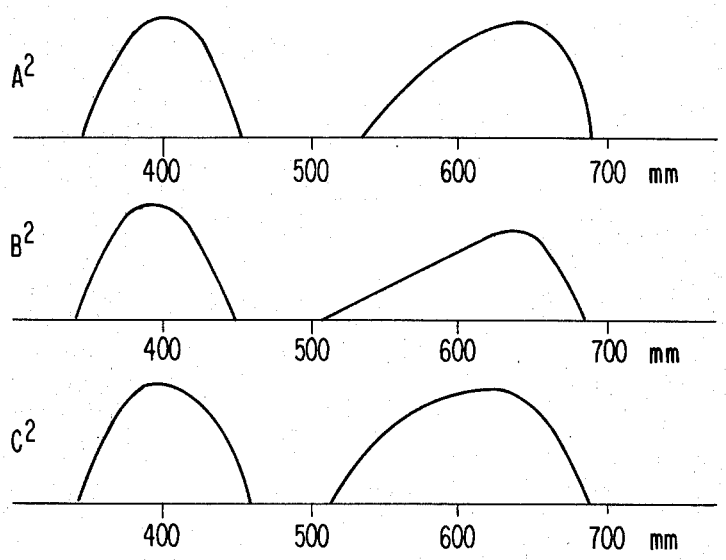
FIG. 3 shows wedge spectrograms obtained in Example 3 with Samples $A_2$, $B_2$ and $C_2$.

Separately, a wedge spectrogram (spectral sensitivity curve) was obtained for each of the film Samples $A_2$, $B_2$ and $C_2$ using a spectrograph containing a tungsten bulb of a color temperature of 2666° K as a light source and a diffraction grating as a spectrograph element. The spectrograms obtained were as shown in FIG. 3 ($A_2$, $B_2$, $C_2$).

A great change in the spectral sensitivity of the spectrally sensitized region of Sample $B_2$ using the known dye occurred as compared with dye-free Sample $C_2$, with the spectral sensitivity around 640 nm being reduced and the spectral sensitivity on the shorter side becoming flat. In particular, the spectral sensitivity region expanded over the range of 500 to 520 nm. For this reason, an increase in light fog due to the safe light source occurred in Sample $B_2$ in site of the addition of the dye to the protective layer. In contrast, such an undesirable expansion of the spectrally sensitized region did not occur in Sample $A_2$ in accordance with the present invention and the spectral sensitivity around the wavelength of 640 nm was not changed as compared with that of Sample $C_2$.

In order to determine the spectrally sensitizing efficiency at a wavelength of 635 nm, each sample was exposed to a tungsten bulb of a color temperature of 2666° K through an interference filter (half value width: 5 nm) of 635 nm in maximum transmission wavelength and a photographic wedge (density grade difference: 0.15) placed immediately before the sample, then development-processed as described before. The red light sensitivity obtained was as follows. The sensitivity is shown in terms of a relative value to the sensitivity of Sample $C_2$, based on the exposure amount required for attaining an effective density of 0.5 excluding fog.

| Sample | Red Light Sensitivity |
|---|---|
| $A_2$ | 0.98 |
| $B_2$ | 0.82 |
| $C_2$ | 1.00 |

Sample $B_2$ using the known dye was inferior to comparative Sample $C_2$ in sensitivity to red light of a wavelength of 635 nm, while Sample $A_2$ in accordance with the present invention was the same as comparative Sample $C_2$ in red light sensitivity.

EXAMPLE 4

To the same silver bromoiodide emulsion as used in Example 1 was added as a sensitizing dye anhydro-3,3′-disulfopropyl-5,5′-dichloro-9-ethylbenzothiacarbocyanine hydroxide in an amount of $10^{-5}$ mol per mol of silver halide. This emulsion was coated on a subbed, 0.18 mm-thick polyethylene terephthalate film in a dry thickness of 5 $\mu$. On this emulsion layer was further coated a solution of the following composition as a protective layer in an amount of 125 cc/m², then dried to prepare Sample D.

| | | |
|---|---|---|
| Gelatin | 10 | g |
| Dye 5 (described hereinbefore) | 3.5 | g |
| Sodium Dodecylsulfate (1 % aq. soln.) | 20 | cc |
| Water to make | 1000 | cc |

Similarly, Sample E was prepared using the same dye as used in Example 3 in place of Dye 5. Also, a dye-free sample was prepared in the same manner, which was referred to as Sample F.

The same safe light exposure test and spectral sensitivity testing as in Example 3 were conducted with Samples D, E and F. The results of the safe light exposure testing were as follows.

| Sample | Exposed | Unexposed | Light Fog |
|---|---|---|---|
| | (a) | (b) | (a - b) |
| D | 0.08 | 0.04 | 0.04 |
| E | 0.61 | 0.04 | 0.57 |
| F | 0.38 | 0.04 | 0.34 |

The light fog of Sample E using the known dye due to safe light was somewhat higher than that of dye-free Sample F. Sample D in accordance with the present invention had much less light fog, thus being quite excellent in adaptability to a safe light.

Figure 4:
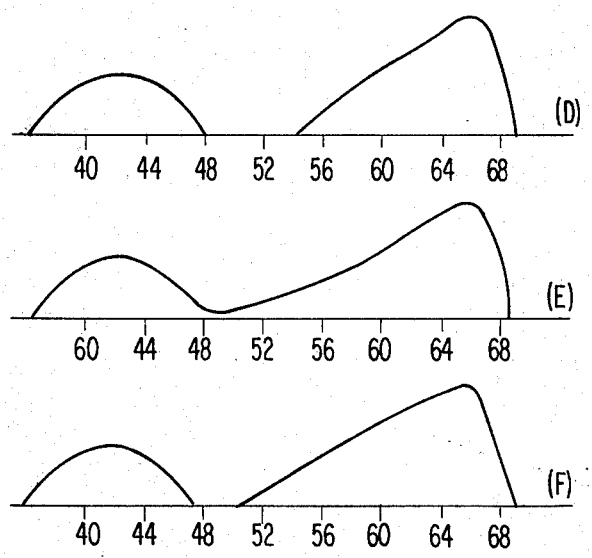
FIG. 4 shows wedge spectrograms obtained in Example 4 with Samples D, E and F.

The wedge spectrograms obtained by the spectral sensitivity test were as shown in FIG. 4. Sample D of the present invention was not different from dye-free Sample F in sensitivity at the main sensitization wavelength of about 660 nm, and the sensitivity at about 520 nm of Sample D was clearly reduced due to the absorption of the dye. On the other hand, with Sample E using the known dye, the sensitivity was rather increased at 490–500 nm as compared with that of Sample F in spite of the fact that it was the wavelength of the absorption of the dye. This is the cause of the increase in light fog in the safe light test.

While the invention has been described in detail and with reference to specific embodiments thereof, it will be apparent to one skilled in the art that various changes and modifications can be made therein without departing from the spirit and scope thereof.

What is claimed is:

1. A silver halide photographic light-sensitive material containing in at least one hydrophilic colloidal layer at least one dye represented by the following general formula (I)

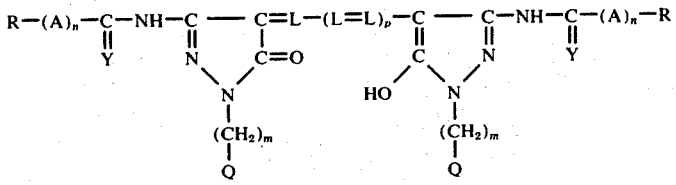

wherein R represents an alkyl group or alkenyl group; A represents an —NH— group; Y represents an oxygen atom or a sulfur atom; Q represents an aryl group substituted with at least one of a sulfo group, a sulfoalkyl group or a carboxy group; $n$ is 0 or 1; $m$ represents an integer of 0, 1 or 2; L represents a methine group and $p$ represents an integer of 0, 1 or 2.

2. The light sensitive material of claim 1, wherein said light-sensitive material contains at least one spectrally sensitized silver halide emulsion layer.

3. The light-sensitive material of claim 1, wherein said light-sensitive material contains at least three silver halide emulsion layers having different spectral sensitivities, with at least two of the silver halide emulsion layers being spectrally sensitized.

4. The light-sensitive material of claim 1, wherein said alkyl group for R is an unsubstituted alkyl group having 1 to 10 carbon atoms or a substituted alkyl group containing one or more of a halogen atom, an alkoxycarbonyl group or a cyano group as substituents and having 1 to 6 carbon atoms in the alkyl moiety thereof; said aryl group for Q is a phenyl group or a naphthyl group containing at least one of a sulfo group, a sulfoalkyl or a carboxy group as substituents and Q may contain as substituents one or more of an alkyl group having from 1 to 4 carbon atoms, a halogen atom, an alkoxy group having 1 to 4 carbon atoms or a phenoxy group; and L represents an unsubstituted methine group or a methine group substituted with an alkyl group having 1 to 3 carbon atoms, a phenyl group, a benzyl group, a phenethyl group or a halogen atom; and wherein said sulfo-group, said sulfoalkyl group and said carboxy group of Q can be in the form of an alkali metal salt, an alkaline earth metal salt, an ammonium salt, or a salt of an organic base.

5. The light-sensitive material of claim 1, wherein Q is a phenyl or naphthyl group substituted with 1 to 2 sulfo groups.

6. The light-sensitive material of claim 5, wherein Q is a 4-sulfophenyl group and $m$ is 0.

7. The light-sensitive material of claim 5, wherein said sulfo groups are in the form of an alkali metal salt, an ammonium salt or a salt of an organic base.

8. The light-sensitive material of claim 1, wherein said methine chain is unsubstituted or substituted with one methyl group.

9. The light-sensitive material of claim 1, wherein said dye is:

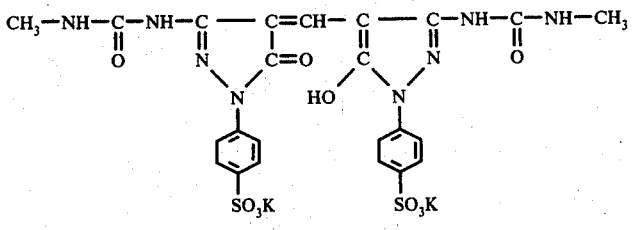

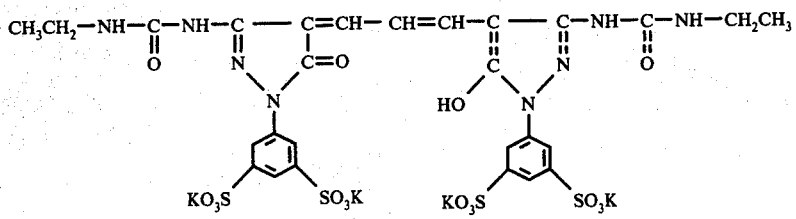

-continued
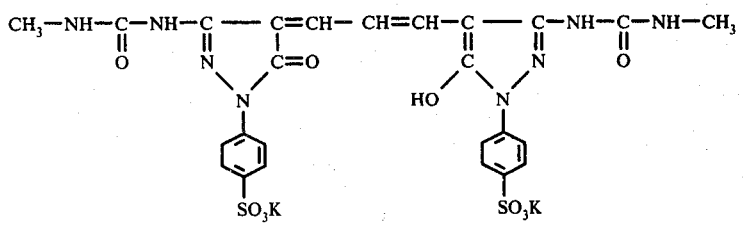
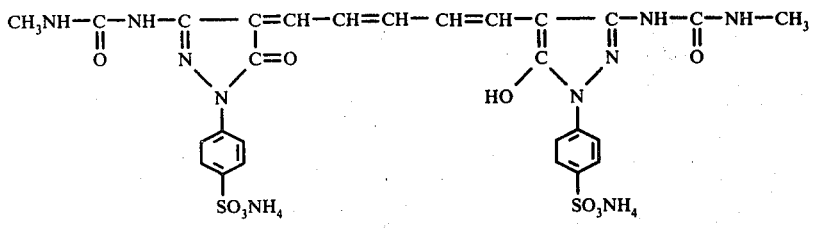
or
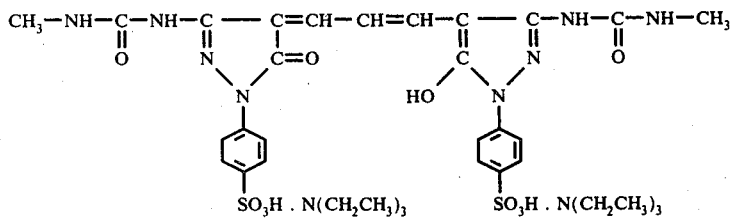
* * * * *